US011950639B2

(12) United States Patent
Edmark et al.

(10) Patent No.: US 11,950,639 B2
(45) Date of Patent: Apr. 9, 2024

(54) ADJUSTABLE STRAP

(71) Applicant: Andra Group, LP, Dallas, TX (US)

(72) Inventors: Tomima L. Edmark, Dallas, TX (US); Ceri Reynolds-Stone, Dallas, TX (US)

(73) Assignee: ANDRA GROUP, LP, Dallas, TX (US)

( * ) Notice: Subject to any disclaimer, the term of this patent is extended or adjusted under 35 U.S.C. 154(b) by 0 days.

(21) Appl. No.: 17/952,994

(22) Filed: Sep. 26, 2022

(65) Prior Publication Data

US 2023/0013689 A1 Jan. 19, 2023

Related U.S. Application Data

(63) Continuation of application No. 16/719,027, filed on Dec. 18, 2019, now Pat. No. 11,484,069.

(60) Provisional application No. 62/840,844, filed on Apr. 30, 2019.

(51) Int. Cl.
*A41C 3/00* (2006.01)

(52) U.S. Cl.
CPC ..... *A41C 3/0028* (2013.01)

(58) Field of Classification Search
CPC . A41C 3/02; A41C 3/0021; A41F 1/04; A41F 1/002
USPC ..... 450/85, 86
See application file for complete search history.

(56) References Cited

U.S. PATENT DOCUMENTS

| | | | | |
|---|---|---|---|---|
| 2,090,864 | A * | 8/1937 | Grein | A41F 1/006 33/15 |
| 2,738,509 | A * | 3/1956 | Bauder | A41F 1/006 2/325 |
| 2,753,563 | A | 7/1956 | Blitch | |
| 2,970,597 | A | 2/1961 | Michel | |
| 3,334,632 | A * | 8/1967 | Rashkin | A41F 1/006 450/86 |
| 4,286,601 | A * | 9/1981 | Farino | A41C 3/10 450/62 |
| 4,300,568 | A * | 11/1981 | Blanckmeister | A41F 1/006 450/85 |
| 4,325,378 | A | 4/1982 | Wilkinson | |
| 5,201,100 | A | 4/1993 | Cardinale | |
| 6,123,601 | A * | 9/2000 | Hildebrandt | A41F 1/006 450/82 |
| 6,319,091 | B1 | 11/2001 | Kilbride et al. | |
| 7,314,400 | B2 | 1/2008 | Fildan et al. | |
| 7,931,521 | B1 | 4/2011 | Griffin | |

(Continued)

*Primary Examiner* — Gloria M Hale
(74) *Attorney, Agent, or Firm* — Braxton Perrone, PLLC; Bobby W. Braxton; Gregory Perrone

(57) ABSTRACT

An adjustable strap comprises an elongated length and mating fastening portions on one side of the strap adjacent to one end of the strap. Gaps or spaces between the mating fastening portions or members provide a tactile effect or response when adjusting the strap to the closed position. The strap is permanently or releasably secured at one end to an attachment point or stabilizing component. The opposite end with the mating fastening portions folds to mate the portions and secure the strap in a closed configuration. The length of the strap can wrap around an object to mate the fastening portions. Alternatively, the length can interact with an additional stabilizing component or guiding member before mating the fastening portions to secure the strap.

11 Claims, 12 Drawing Sheets

(56) References Cited

U.S. PATENT DOCUMENTS

| | | | | |
|---|---|---|---|---|
| 8,167,679 | B2 * | 5/2012 | Seraceno | A41C 3/02 450/86 |
| 8,172,639 | B2 | 5/2012 | Swendseid | |
| 8,267,740 | B1 * | 9/2012 | Afxentiou | A41C 3/0021 450/86 |
| 8,439,722 | B2 | 5/2013 | Buriak | |
| D712,306 | S | 9/2014 | Fildan et al. | |
| 8,932,104 | B2 * | 1/2015 | Moylan | A41C 3/0057 450/23 |
| 9,462,833 | B1 * | 10/2016 | Spaulding | A41D 7/005 |
| 9,700,083 | B2 | 7/2017 | DeCotiis | |
| D865,321 | S | 11/2019 | Edmark | |
| 11,484,069 | B2 * | 11/2022 | Edmark | A41F 1/006 |
| 2003/0115662 | A1 * | 6/2003 | Dobbie | A42B 3/085 348/E5.09 |
| 2009/0075562 | A1 * | 3/2009 | Lung | A41C 3/12 450/86 |
| 2010/0190411 | A1 * | 7/2010 | Saraceno | A41C 3/02 450/86 |
| 2012/0142253 | A1 * | 6/2012 | Javaid | A41C 3/04 450/80 |
| 2012/0174346 | A1 * | 7/2012 | Fildan | A41F 1/006 24/303 |
| 2014/0349550 | A1 * | 11/2014 | Campbell | A41C 3/0021 450/60 |

* cited by examiner

ADJUSTABLE STRAP

PRIORITY

The present invention is a continuation of U.S. application Ser. No. 16/719,027 filed Dec. 18, 2019, now issued as U.S. Pat. No. 11,484,069 which claims priority to Provisional Application No. 62/840,844, filed Apr. 30, 2019 entitled "Adjustable Strap", the entirety of both of which are hereby incorporated by reference.

BACKGROUND OF THE INVENTION

Technical Field

The present invention relates generally to an adjustable strap; and more specifically, to an adjustable strap used to fasten or secure an item in place or to close a band, such as for securing garments or bags to a wearer.

History of Related Art

The hook and eye closure system, which consists of at least one eyelet and a corresponding metal hook to mate with the eyelet, is well known to consumers and has uses in many fields. For example, a bra typically includes straps that extend from either side of the cups and around the ribcage to the back of a wearer. The straps have ends that meet to attach to one another at the back of a user, historically, by way of a hook-and-eye closure near the spine of its wearer. Swimwear has a hook and loop option for closing similar straps that meet at the back. A number of applications in the apparel industry as well as in the medical industry make use of fastening systems. There is a need for an improved way of closing or fastening straps such that the band or tension created by the strap is adjustable and secure.

SUMMARY

Described herein is an adjustable strap capable of providing tension to close and secure a band or retain an item in place. The adjustable strap is useful and applicable to numerous apparel and accessories to be worn by a user such as garments, undergarments, belts, bags, backpacks, baseball caps, and various sports apparel clothing and gear as well as any number of fields or applications where adjustability of a retaining strap is desired.

One object of the invention is to provide a bra that may be easily adjusted to provide a variety of fits when worn to conveniently conform to the size of a wearer's torso. Another object of the adjustable strap described herein provides for similar adjustability around a user's limbs or for supporting an object's weight when the ends of the strap are connected to or around rigid or semi-rigid structures.

In a first aspect, an adjustable strap comprises a length extending between a first end and a second end, the length comprising a first side and a second side; a first fastening portion adjacent to a mating second fastening portion, the first fastening portion and the mating second fastening portion near one end of the length and on one side of the length; wherein at least one of the first fastening portion and the mating second fastening portion comprises a plurality of fastening members and at least one space between the plurality of fastening members.

In a second aspect, an article comprises an adjustable strap comprising a length extending from a first end to a second end, the first end secured to an attachment point and the second end comprising a first fastening portion adjacent to a mating second fastening portion, the adjacent fastening portions near the second end and on one side of the adjustable strap; wherein at least one of the first fastening portion and the mating second fastening portion comprises a plurality of fastening members with at least one space between each of the plurality of fastening members. In some embodiments, the article is an article worn by a user.

In a third aspect, a bra comprises a breast-receiving portion and an elongated strap attached to the breast-receiving portion, wherein the elongated strap comprises a first side, a second side opposite the first side, and a length extending from a first end to a second end, the first end secured to the bra and the second end comprising a first fastening portion adjacent to a mating second fastening portion on one side of the length, wherein at least one of the first fastening portion and the mating second fastening portion comprises a plurality of fastening members with at least one space between each of the plurality of fastening members.

In a fourth aspect, a bra comprises a breast-receiving portion and at least two elongated straps extending from either side of the breast-receiving portion, each elongated strap comprising a length extending from a first end to a second end and comprising a first side and a second side, the first end secured to an attachment point near the breast-receiving portion, wherein each elongated strap comprises a first fastening portion adjacent to a mating second fastening portion on one side, wherein the fastening members are near the second ends of each of the elongated straps.

In any of the above embodiments, the first fastening portion and the mating second fastening portion are near the second end. In any of the above embodiments, the first end is secured to an attachment point. In some embodiments, the second end communicates with the attachment point to form a loop around an object, the second end folded at the attachment point, the first fastening portion mating with the second fastening portion to secure the strap around the object.

In some embodiments, the length forms on itself at an engagement component, such that the second end is pulled towards the first end, forming a first fold at the engagement component. The engaging component may be permanently or releasably secured to any number of objects. For example, the engaging component may be secured to the attachment point to form an independent retaining strap; the engaging component may be secured to an extension or item between the attachment point and the engaging component; or the engaging component may be securing to one or more straps, the plurality of straps used for holding weight in place. In certain embodiments, the length forms a second fold at a guiding component near the attachment point.

In any of the above embodiments when mating the fastening portions and adjusting the length of the strap, the fold creases at one of: a gap between the first fastening portion and the mating second fastening portion and the space between the fastening members. In any of the above embodiments, adjusting the strap to the desired length produces a useful tactile effect for a user.

Other aspects, embodiments, and features of this disclosure will become apparent in the following written description and accompanying drawings.

BRIEF DESCRIPTION OF THE DRAWINGS

The novel features believed characteristic of the invention are set forth in the appended claims. The invention itself, however, as well as further objectives and advantages thereof, will be best understood by reference to the following detailed description of illustrative embodiments when read in conjunction with the accompanying drawings, wherein:

DETAILED DESCRIPTION

Several embodiments of Applicant's invention will now be described with reference to the drawings. Unless otherwise noted, like elements will be identified by identical numbers throughout all figures.

Figure 1:
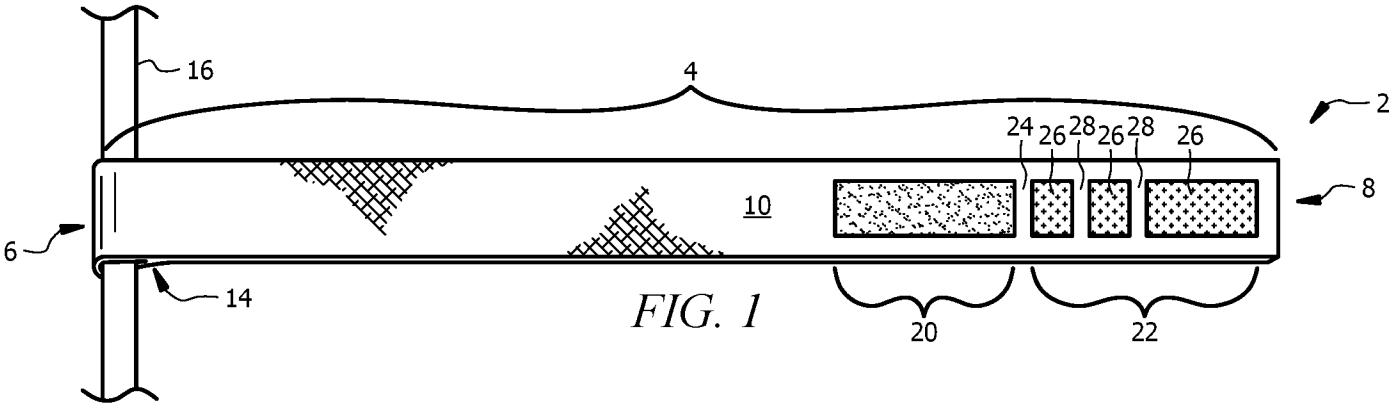
FIG. 1 depicts an embodiment of an adjustable strap disclosed herein in an open configuration.
Figure 2:
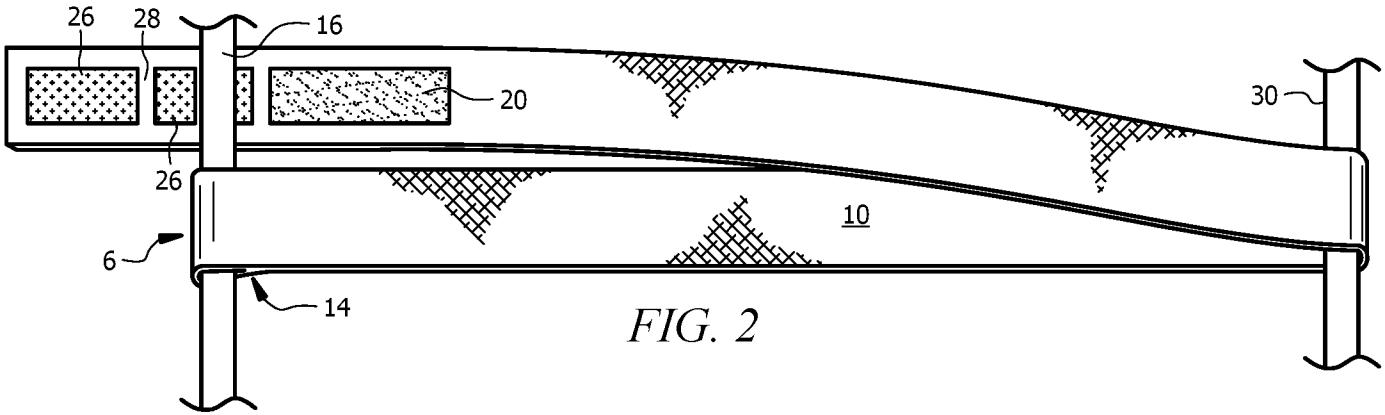
FIG. 2 depicts an embodiment of an adjustable strap disclosed herein.

Various embodiments of an adjustable strap are shown in the Figures. By way of example, a single strap capable of being used in a number of applications, is shown in FIGS. 1 and 2. Various bra embodiments will be shown and described with reference to FIGS. 3-7. An adjustable strap or adjustable strap system is shown in more detail in FIGS. 8-10. As described above, the adjustable strap may be useful with any number of items designed to hold or secure weight.

Referring now to FIG. 1, an adjustable strap 2 comprises a length 4 extending from a first end 6 to a second end 8, the length 4 comprising a first side 10 and a second side opposite the first side. Both the first side 10 and its opposing side comprise a substantially planar side or surface. A first fastening portion 20 is positioned adjacent to a mating second fastening portion 22 near one end of the length 4 (depicted near the second end 8). The adjacent fastening portions 20, 22 may comprise female and mating male counterparts in some embodiments. Suitable fastening portions will be further described below. As depicted in the figures, the first fastening portion and the mating second fastening portion are on one side 10 (i.e., the same side) of the length 4. At least one of the first fastening portion 20 and the mating second fastening portion 22 comprises a plurality of fastening members with at least one space in between each of the members 26. While depicted to indicate the mating second fastening portion 22 comprises the members 26, the first second fastening portion 20 may also (or instead) comprise the members, so long as at least a portion of the fastening members mate together to close the strap. The first end 6 is secured to an attachment point 16, which may comprise any number of structures, items, or shapes, including but not limited to a rod, pole, ring, etc. The first end 6 may be permanently or releasably secured to the attachment point 16, which serves as a stabilizing component. FIG. 1 depicts the first end wrapped around the attachment 16 at 14, as may be performed, for example, by sewing or gluing the ends together or by use of Velcro. The strap 4 may wrap around an object (not depicted) such that the second end 8 is caused to attach to the attachment point 16, before mating the fastening portions 20, 22, thereby closing or securing the strap around the object. The second end thus communicates with the attachment point to form a loop around an object, the second end folded at the attachment point, allowing the first fastening portion to mate with the mating second fastening portion and forming a single fold in the length of the strap. In embodiments in which the attachment point 16 is a loop or ring, the second end 8 may pass through the opening of the attachment point 16. In certain embodiments, the single fold that mates the fastening portions 20, 22 comprises a crease at a gap 24 between the first fastening portion and the mating second fastening portion. In alternate embodiments, the single fold creases at one of the spaces 28 between the fastening members 26. In any embodiment, the size of gap 24 will be substantially equal to the size of the spaces 28. The gap 24 and spaces 28 thereby allow for an adjustability of the length of the strap in the closed position.

FIG. 2 depicts further possible embodiments of the adjustable strap described herein. In this embodiment, an engaging component 30 is positioned a distance from the attachment point 16 to provide for an additional stabilizing component, such that the second end 8 is pulled towards the first end 6, forming a first fold at the engaging component 30. In some embodiments, wherein the adjacent mating portions 20, 22 are on an exterior side 10 (as shown in FIG. 1), the second end 8 may wrap forwardly on itself around the engaging component 30 and mate the adjacent mating portions 20, 22 at the first fold to secure the strap in the closed position. In alternate embodiments, the length 4 forms a first fold at the engaging component 30 and then a second fold at a guiding component near the attachment point. In some embodiments, as shown in FIG. 2, the attachment point comprises the guiding component and the adjacent mating portions 20, 22 are positioned on the interior side 10 of the strap when in the open configuration. In certain embodiments, the second fold creases at the gap 24 between the first fastening portion 20 and the mating second fastening portion 22. In other embodiments, the second fold creases at one of the spaces 28 between the plurality of fastening members 26. In alternate embodiments, further described below, the guiding component is an additional structure near or on the attachment point 16. Thus, it can be seen that the strap 4 can comprise any number of lengths 4, as well as widths, and any number of members of its fastening portions, depending upon the object that should be secured with the strap.

Embodiments wherein an adjustable strap as described herein may be incorporated comprise any number of fields. One embodiment described in detail below relates to a bra comprising a breast-receiving portion and an elongated (adjustable) strap attached to the breast-receiving portion, wherein the elongated strap comprises a first side, a second side opposite the first side, and a length extending from a first end to a second end, the first end secured to the bra and the second end comprising a first fastening portion adjacent to a mating second fastening portion on one side of the length, wherein at least one of the first fastening portion and the mating second fastening portion comprises a plurality of fastening members with at least one space between each of the plurality of fastening members.

Referring to FIGS. 3-7, a bra 32 comprises an adjustable strap and a breast-receiving portion comprised of adjacent breast-receiving cups 34, each cup optionally connected to a side portion 38 extending from either side of the breast-receiving portion. While FIGS. 3-7 depict one embodiment with two elongated straps and the adjustable features described herein, in some embodiments, a bra or item to be worn may comprise only one elongated strap having the adjustable features described herein.

In some embodiments, the breast-receiving portion comprises two breast-receiving cups 34 and a center panel or portion 36 between the two-breast receiving cups 34. In some embodiments, the center panel is optional. The center portion 36 may comprise an optional opening in the center in certain embodiments. For example, a clasp may be permanently connected to the two breast-receiving cups, allowing for the bra to be opened in the front. In other embodiments, the center portion 36 between the breast-receiving cups is free of any clasp. In some embodiments, the cups 34 are attached by a center portion 36 attached via stitching or zipper. In some embodiments, the breast-receiving portion comprises a center portion integral to the breast-receiving cups. In other embodiments, the breast-receiving portion comprises cups adjoined at a center common seam. In other embodiments, the breast-receiving portion comprises a single or seamless compartment for receiving both breasts. Other embodiments wherein breast-receiving cups are permanently or releasably attached to each other are also possible and within the scope of the invention.

The breast-receiving cups 34 may comprise any number of configurations known in the art, including, without limitation, a single compartment cup (i.e., a seamless cup), a multi-compartment (or multi-seam) cup, a full-cup, a partial cup, a plunge cup, a nursing cup, a molded cup, a wire-free cup, and a padded cup. In some embodiments, each of the breast-receiving cups 34 comprises an underwire or semi-circular strip of rigid material fitted inside the fabric of the bra.

Figure 3:
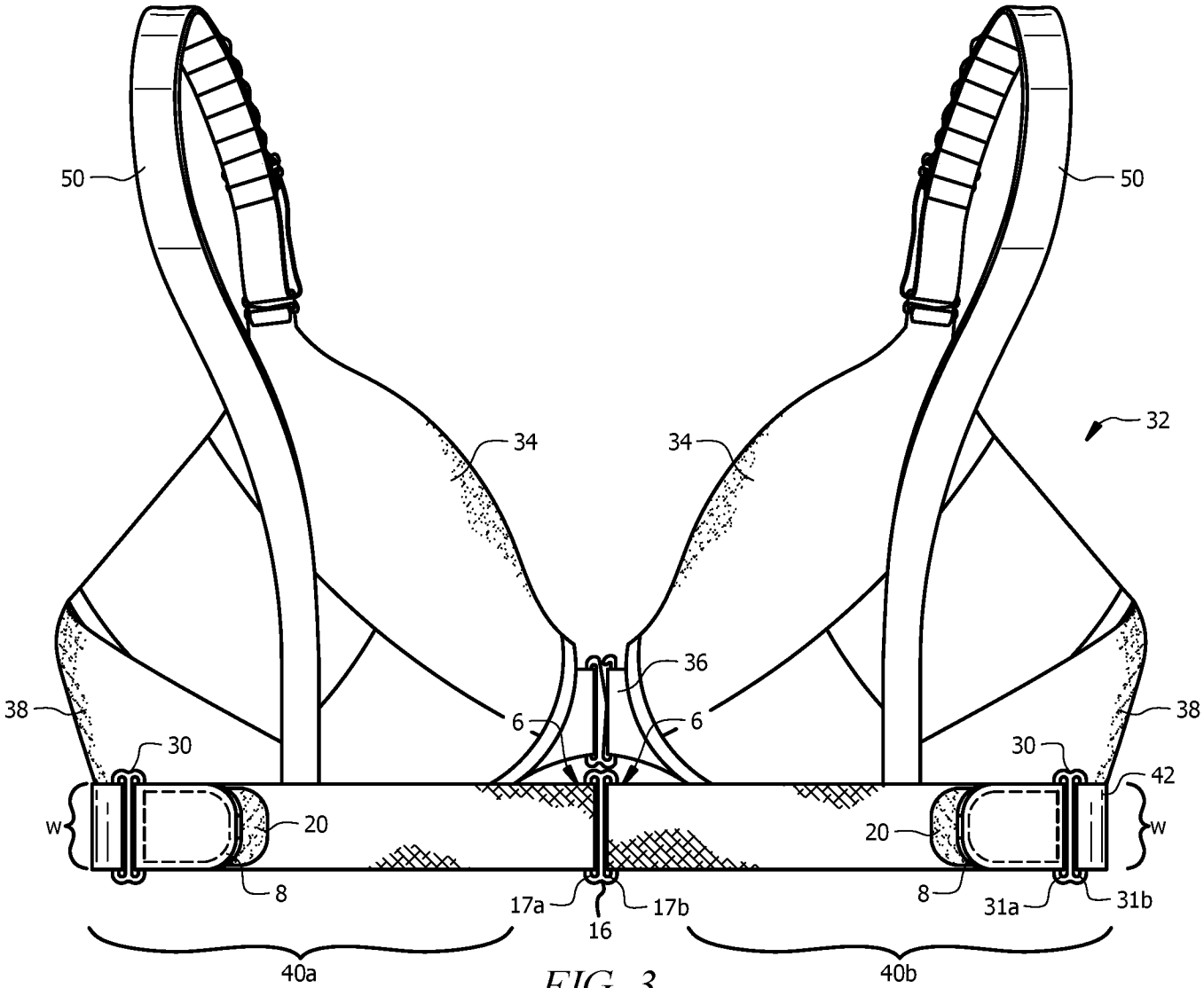
FIG. 3 depicts a rear view of one embodiment of an undergarment comprising an adjustable strap described herein in a closed configuration.
Figure 7:
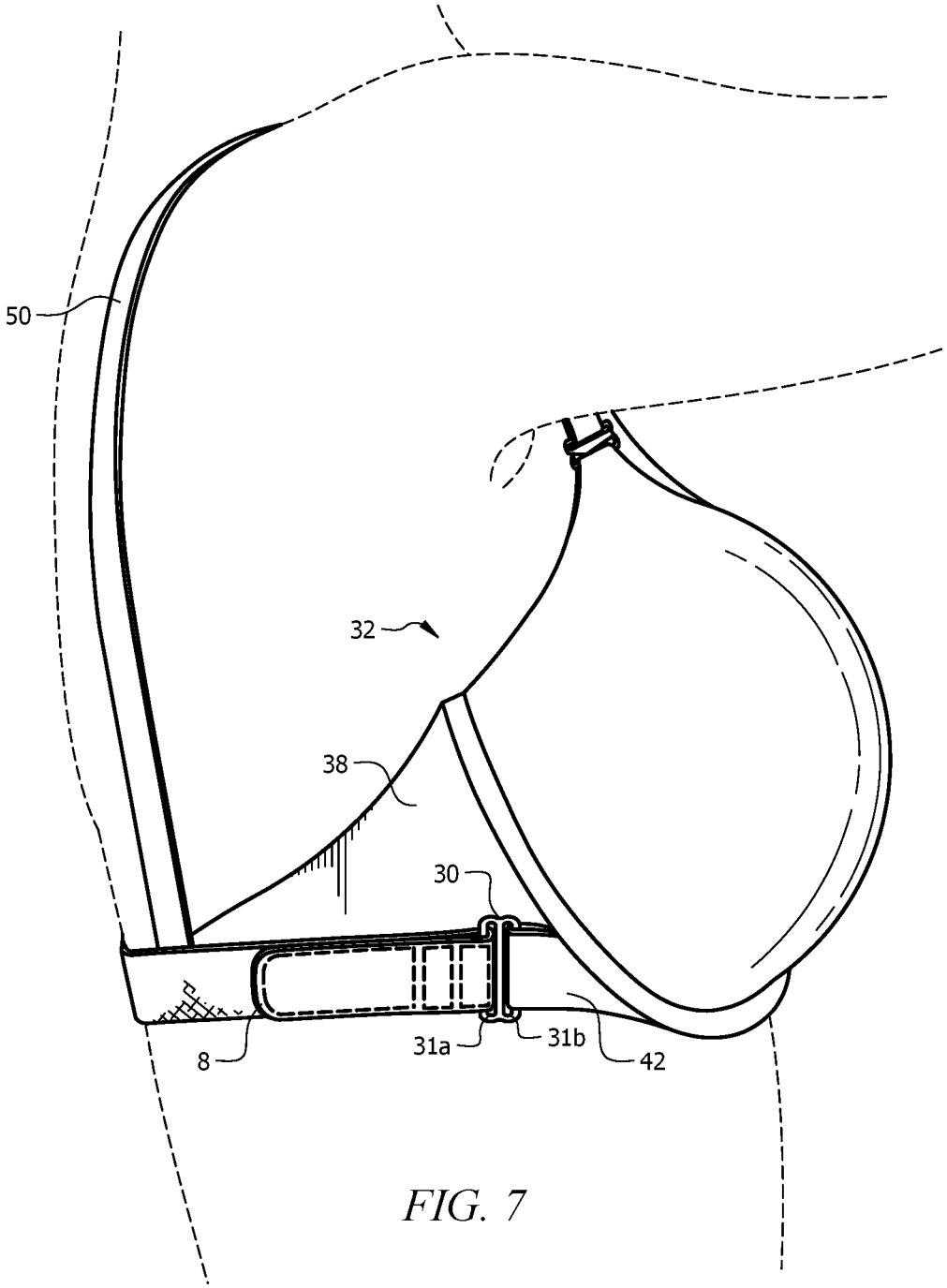
FIG. 7 depicts a side view of an embodiment of an undergarment described herein in a secured position, as worn by a user.

Extending from a side of the breast-receiving front portion is an elongated, adjustable strap. The elongated straps 40*a*, 40*b* each comprise a length extending from a first end 6 to a second end 8. The first end of the elongated strap of a bra 32 is secured to an attachment point on the bra. In some embodiments, as shown in FIGS. 3 and 7, the strap is attached at its first end at an attachment point on a side portion 38. In some embodiments, each side portion 38 tapers down on an upper edge towards an elongated strap. In some embodiments, the side portion 38 comprises a width similar to that of the elongated strap. In some embodiments, the side portion 8 is connected by way of a side seam. However, bra embodiments described herein may or may not comprise a side seam. The elongated strap may be connected to its side portion by any number of means known in the art. In some embodiments, each elongated strap 40*a*, 40*b*, is integral with the respective side portion 38. In some embodiments, each elongated strap 40*a*, 40*b* is permanently secured to its respective wing portion 38, for example, by stitching.

In some embodiments, the elongated strap may extend integrally or directly from a cup or breast-receiving portion without the need for the side portion 38. In some embodiments, the adjustable strap is attached, whether permanently, semi-permanently, or temporarily, directly to a breast-receiving portion. As best shown in the top view of the open configuration of FIG. 4, straps 40*a*, 40*b* comprise a first end 6 (also referred to herein as the secured end) and a second end 8, which could also be referred to as the free end. In some embodiments, the two elongated straps 40*a*, 40*b* together refer to an adjustable strap system forming the backstrap of the bra 32.

In certain embodiments, the width of the elongated strap remains substantially consistent from the first (attached) end 6 to the second (free) end 8. In certain embodiments, the width of the elongated strap may vary from its secured end to the free end. In certain embodiments, the strap comprises a width of no less than about one inch. In some embodiments, the strap comprises a width of up to 18 inches. In some embodiments, the strap comprises a width of between about 1 inch to about 18 inches. In some embodiments, the strap comprises a width of between about 1.5 inch to about 6 inches. In some embodiments, the width of the elongated strap may taper from a wider end at a first end to a narrower end at a second end. In other embodiments, the width of the elongated strap may taper from a narrower end at a first end 8 to a wider end at a second end 14. Whether the width w of the elongated strap is consistent or variable, in some embodiments, the strap may be pulled down in the worn position to increase the backstrap width and thereby reduce back fat bulges.

In certain embodiments, one of more of the elongated straps 40*a*, 40*b* is of a sufficient length to fold forwardly on itself up to two times, as detailed herein, while remaining secured at the first end at an attachment point. In some embodiments, the length of one or more of the elongated strap 40*a*, 40*b* comprises a single width from the first (secured) end to the second (free) end. Other embodiments with a variable width are also possible. In some embodiments, the adjustable strap further comprises a bonding across at least a portion of the strap.

In certain embodiments, one or both straps 40*a*, 40*b* also comprise a planar shape with an interior or inner side 10 and an exterior or outer side 12, both sides thus comprising a substantially flat surface. A first side 10 of the strap may be located on the inner side of the strap when the strap is an extended open position, and may thus be referred to as the interior side in some embodiments. That is, the first side 10 of the strap is on the same side of the bra as the concave portion that receives a breast.

Figure 5:
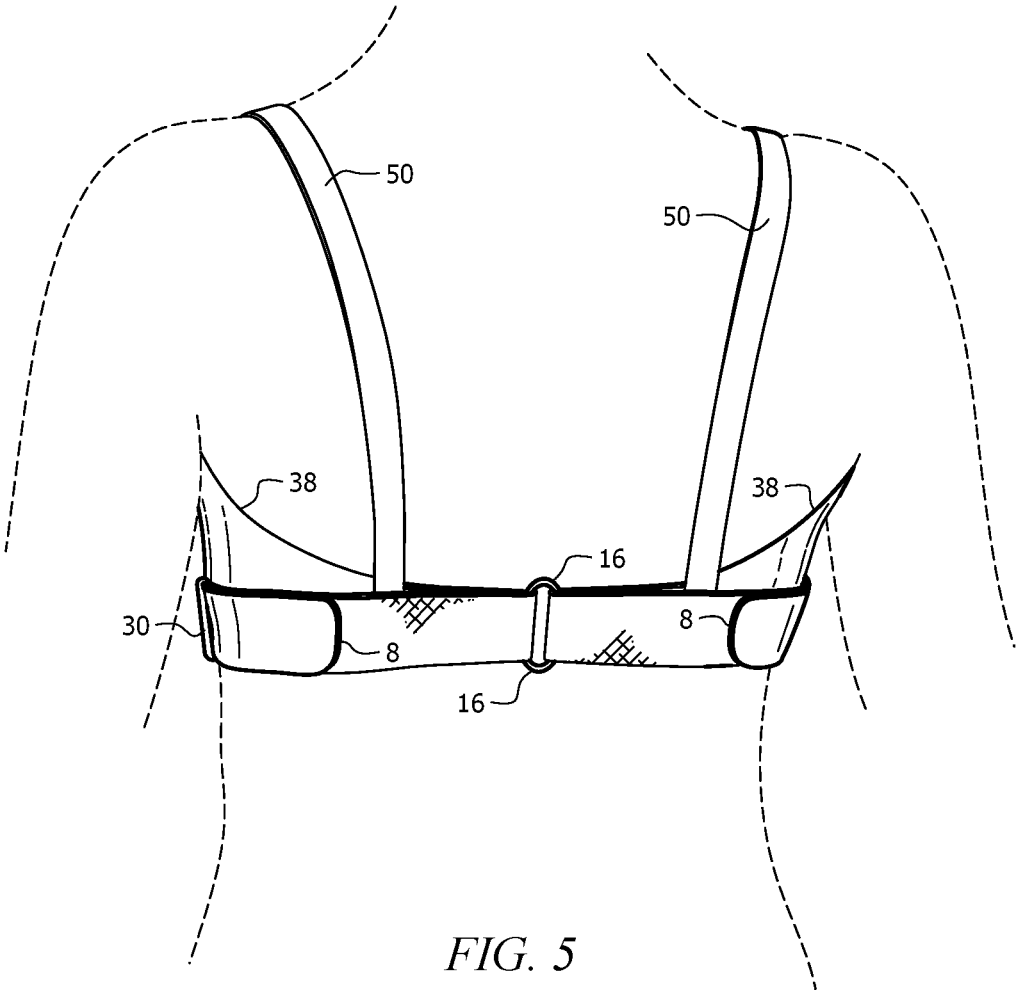
FIG. 5 depicts a back view of an undergarment disclosed herein, as it would be worn by a user in a secured position.

With reference to FIGS. 3 and 5, in some embodiments, in a closed or worn configuration, the adjacent adjustable straps 40*a*, 40*b* form a symmetrical backstrap with an engaging component 30 between a first adjustable strap 40*a* and a second adjustable strap 40*b*. In some embodiments, in a closed or worn configuration, the adjustable straps form a symmetrical front portion. In some embodiments, the straps are of such a length as to be in the closed position at the front of the bra.

Figure 4:
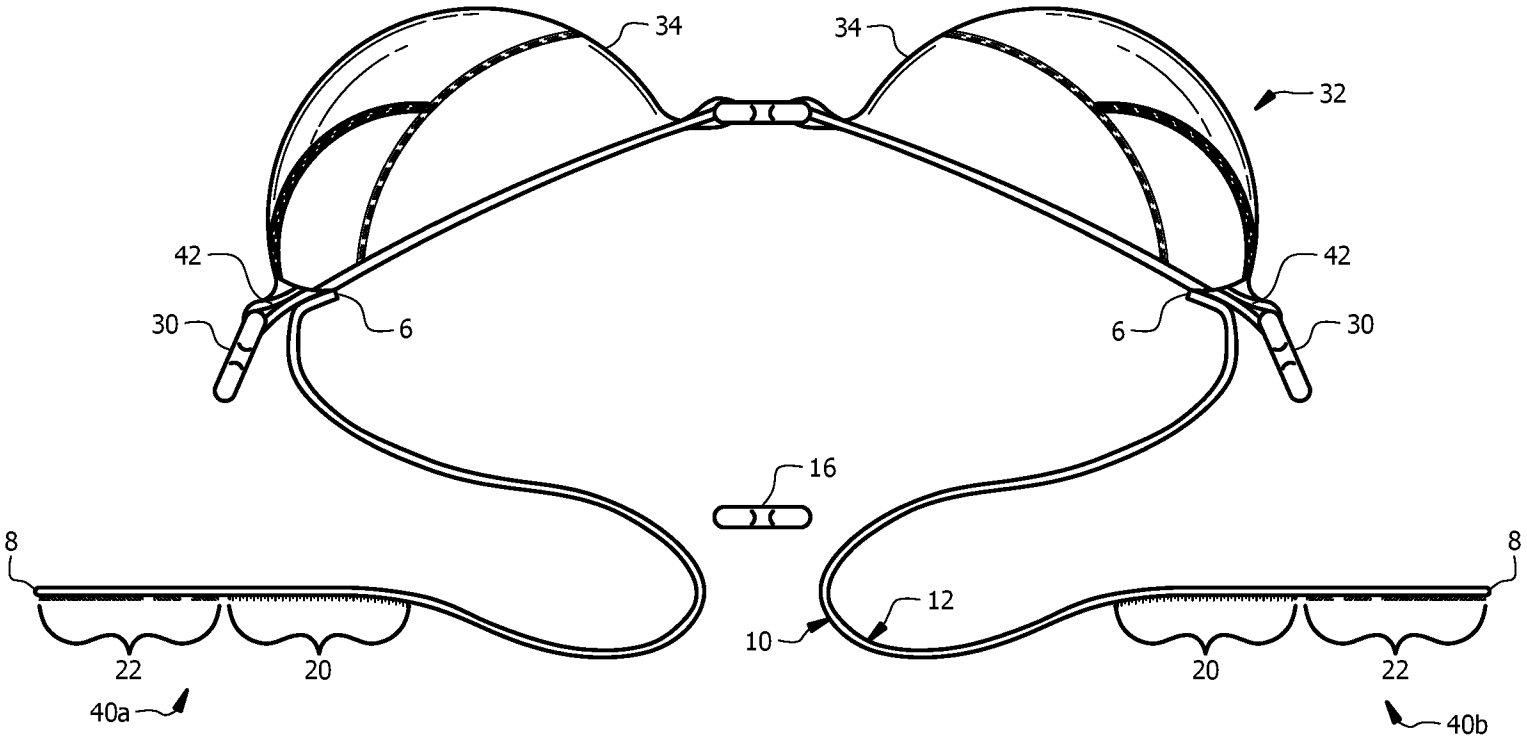
FIG. 4 depicts a top view of one embodiment of an adjustable band of an undergarment as described herein in an open configuration.

Next to a free end 8, in the embodiment of FIG. 4, the interior side 10 of an elongated strap 40*a*, 40*b* comprises a first fastening portion 20 adjacent to a mating second fastening portion 22 (best shown in FIGS. 4, and 8-10). At least one of the first fastening portion 22 and the mating second fastening portion 22 comprises a plurality of fastening members with at least one space between each of the plurality of fastening members. As perhaps best shown in the embodiment of FIGS. 8-10, further described below, a small gap 24 separates the first fastening portion 20 from the mating second fastening portion 22. In certain embodiments, the gap 24 is small enough to allow the strap to wrap snugly around a piece of hardware such as an attachment point 16 or an engaging component 30, described below. The first end 6 is secured to the bra 32 at an attachment point. An engaging component 16 is an independent piece of hardware in some embodiments. A guiding component 30 is further attached to the bra in those embodiments in which the strap comprises more than one fold. The operation and folding of the strap will be further described below.

In any of the strap embodiments described herein, the first fastening portion and the mating second fastening portion may comprise male and female mating counterparts. In any embodiment described herein, the first fastening portion 20 comprises a female portion such as a loop fastening material and the mating second fastening portion 22 comprises a male portion such as a hook fastening material. In some embodiments, the first fastening portion 20 consists of a loop fastening material and the mating second fastening portion 22 consists of a hook fastening material. Releasably interlocking hook-and-loop fastening material such as Velcro® may be used. The loop fastening material comprises a loop portion covered with a plurality of loops. The hook fastening material comprises a hook portion covered in hooks that mate with the plurality of loops on the loop fastening material. The hook-and-loop strips 20, 22 selectively engage the strap upon itself on the bra. In some embodiments, the loop fastening material and the hook fastening material comprises low-profile hook-and-loop material strips. In some embodiments, the loop fastening material and the hook fastening material consists of low-profile hook-and-loop material strips. It should be noted that while the first fastening portion is depicted at 20 in the Figures, and the second fastening portion is depicted at 22, an alternate embodiment may comprise the mating second fastening portion at 20 and the first fastening portion at 22.

Figure 8:
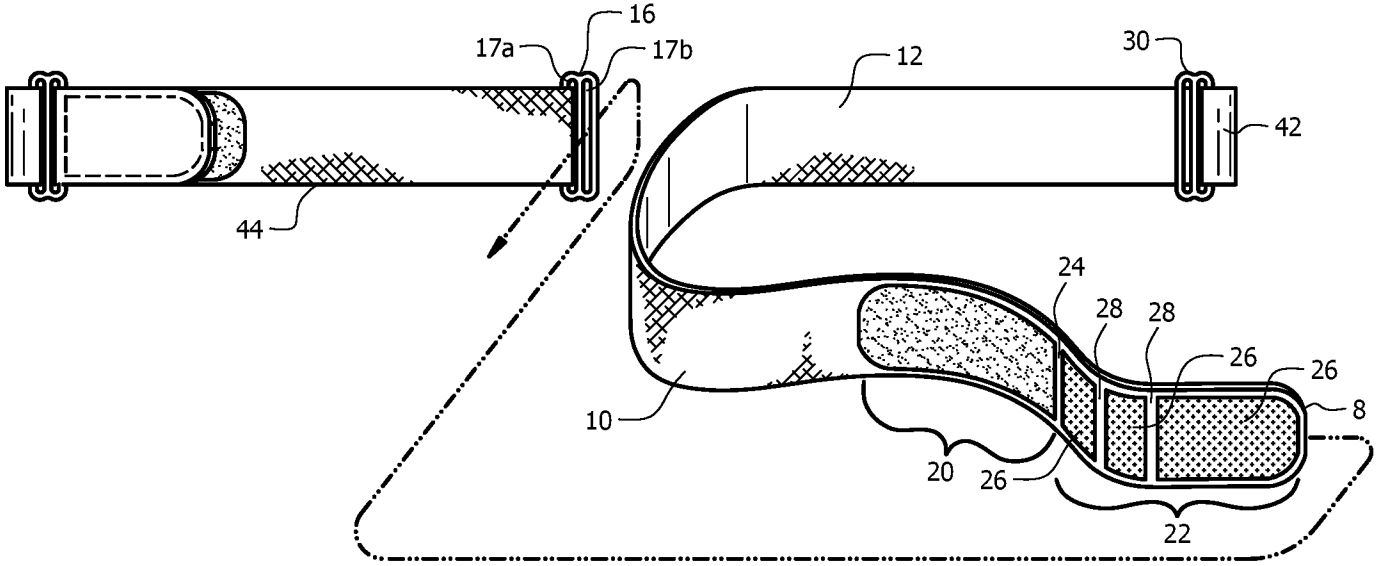
FIG. 8 depicts a close-up view of an embodiment of an adjustable strap described herein in a partially open configuration prior to engaging the strap with an engaging component.

In any embodiments of a strap described herein, at least one of the first fastening portion and the mating second fastening portion comprises a plurality of fastening members 26 as best depicted in FIG. 8, with a space 28 in between the members 26. In some embodiments, the plurality of members 26 comprises segments of the fastening material. In some embodiments, the plurality of members 26 comprises ribbed portions of the fastening material. A ribbed hook-and-look material may comprise a ribbing or ribbed sliver on the fastening portion 22, in which portions of the fastening member are shorter or a layer is removed from a strip of either a hook or loop portion. In some embodiments, the hook-and-loop material is a ribbed on at least one of the male fastening portion and the female fastening portion.

In any of the embodiments described herein, the first fastening portion and the mating second fastening portion may each comprise a magnet. In some embodiments, the first and second fastening portions comprise a set of mating magnets; that is, oppositely poled magnets such that the magnets are attracted to one another to secure the strap in a closed position. Other convenient and releasably interlocking or mating fastener pairs may also be possible in other embodiments including without limitation magnetic closures, buckles, hook-and-loop, ties, buttons, and D-rings. In any embodiment described herein, the fastening members comprise a tactile or audible effect for the user during the adjustment of the strap to a closed position.

In certain embodiments, the elongated strap folds forwardly on itself a single time before engaging the first fastening portion with the mating second fastening portion. In such embodiments, a single fold causes the fastening portions to engage and secure a bra to the user. The fastening portions may engage along any circumference of a closed bra. In some embodiments, the fastening portions engage at the back of the user. In some embodiments, the fastening portions engage at the side of the user. In some embodiments, the fastening members engage at the front of the user.

Figure 6:
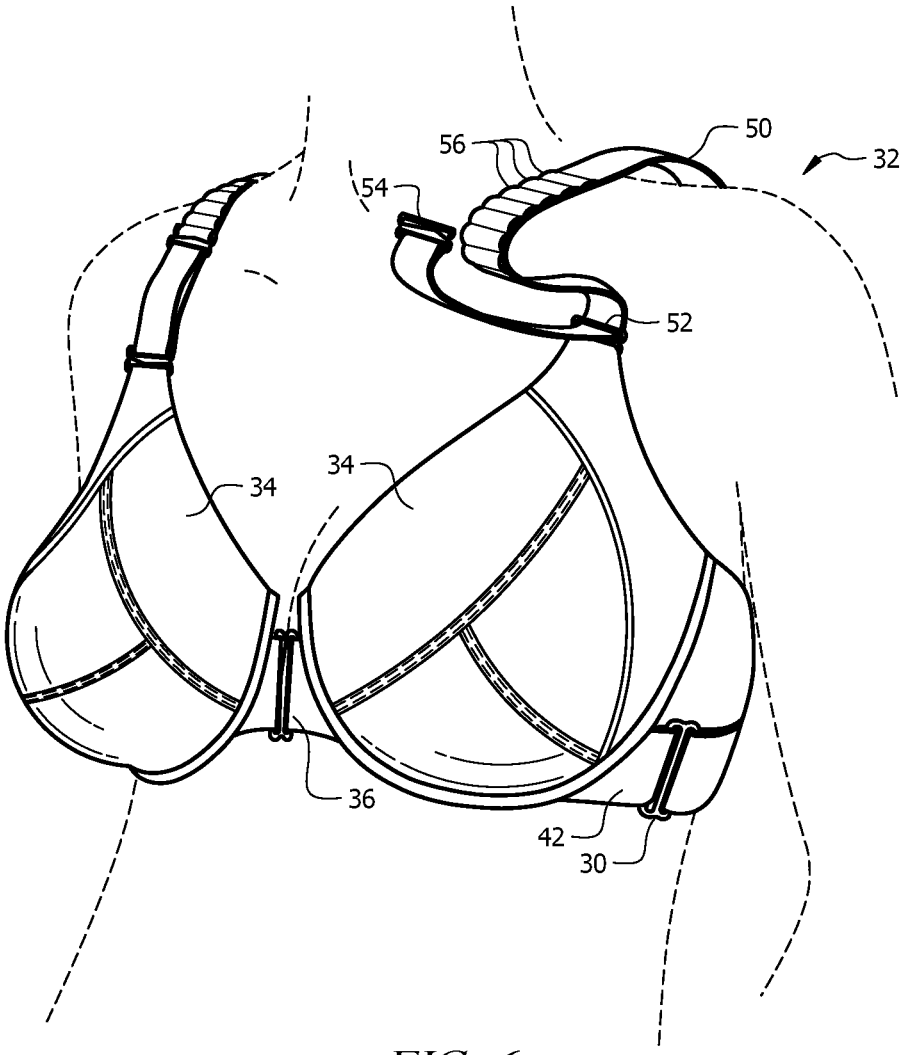
FIG. 6 depicts a front perspective view of an undergarment shown in FIG. 5, as it would be worn by a user in a secured position.

Turning briefly to the shoulder straps of bra embodiments described herein, the shoulder straps may further comprise any number of shoulder strap configurations. As depicted in FIGS. 3 and 6, the bra 32 may comprise a pair of adjustable shoulder straps 50 attached on a back side to a portion of a respective adjustable strap and on a front side to an upper edge of a breast-receiving cup 34. In some embodiments, each of the shoulder straps 50 comprises a ring 52 attached to the upper edge of a respective breast-receiving cup 34, the should strap 50 passing through the ring 52 such that a hook element 54 on a free end of the shoulder strap 50 may engage one of a plurality of loop elements 56 on the shoulder strap 50. Any number of shoulder strap configurations may be used with the adjustable strap(s) described herein, including without limitation crisscross shoulder straps, a single strap attached at either breast-receiving cup and extending around the neck of a user, and shoulder straps forming a T-back shape. In some embodiments, the bra is free of shoulder straps, as with a strapless bra, for example. In some embodiments, the shoulder straps may comprise an adjustable strap as described herein comprising first and second mating fastening portions 20, 22. In some embodiments, one or both shoulder straps may comprise a Velcro portion. In some embodiments, one or both shoulder straps may comprise a magnet. Any other number of adjustable features may also be possible including without limitation magnetic closures, buckles, hook-and-loop, ties, buttons, and D-rings.

Figure 13:
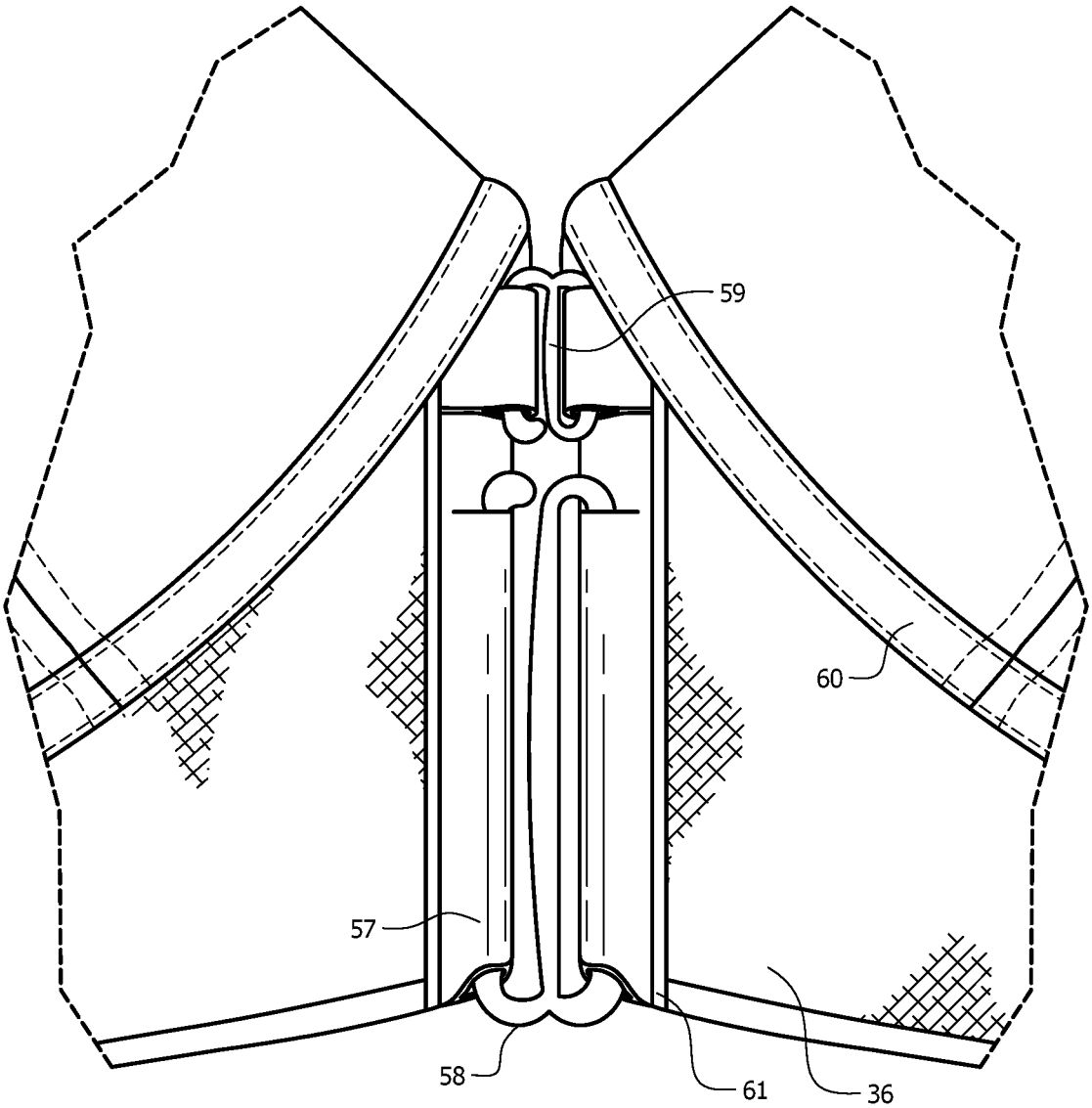
FIG. 13 depicts the front view of the center portion in one embodiment.
Figure 14:
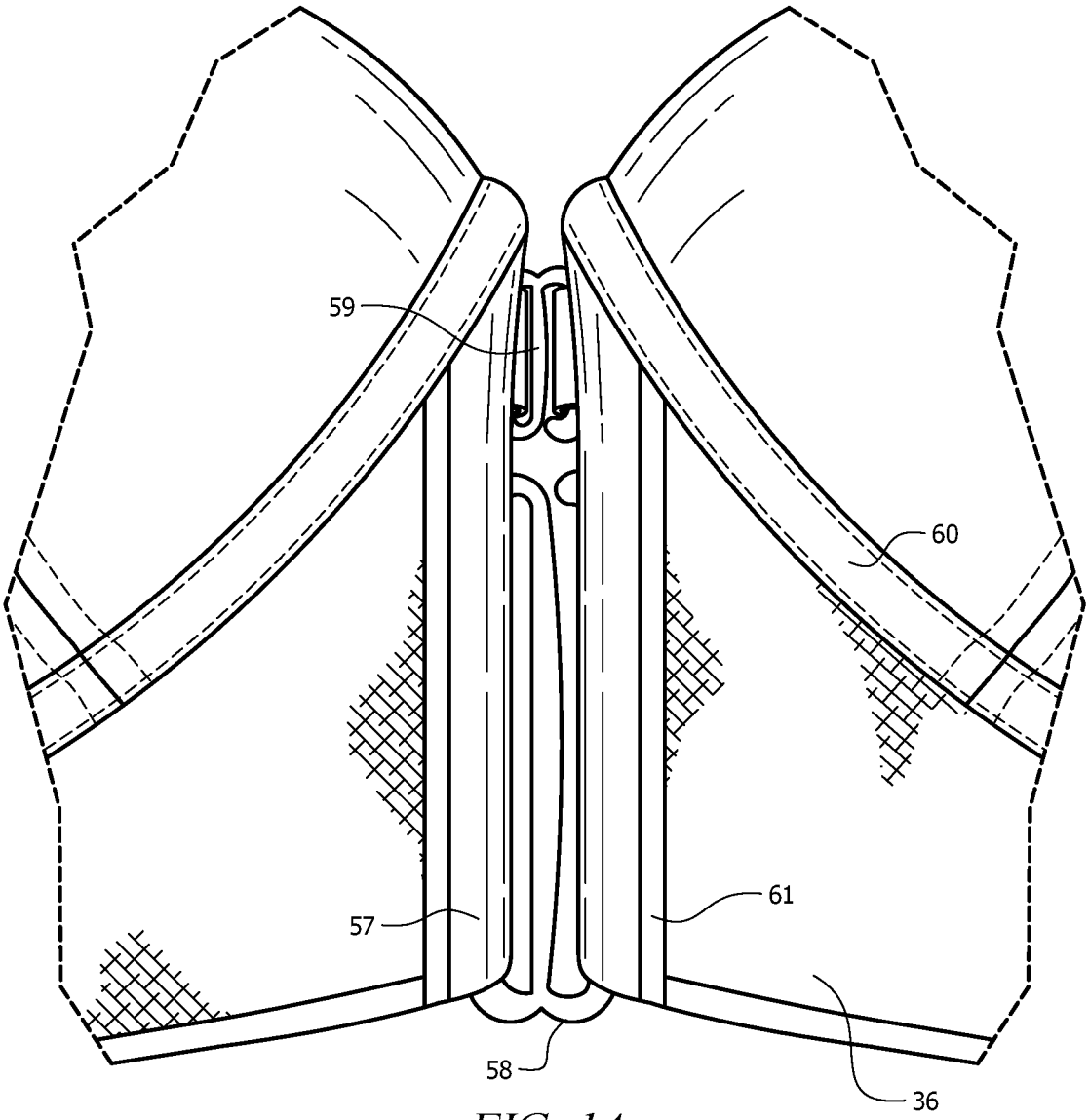
FIG. 14 depicts a rear view of the center portion in one embodiment.

Turning to FIGS. 13 and 14, FIG. 13 depicts the front view of the center portion and FIG. 14 depicts a rear view of the center portion. As shown, FIG. 13 shows the inside of the bra whereas FIG. 14 shows in the outside of the bra. As noted, in one embodiment the breast-receiving portion comprises two breast-receiving cups 34 and a center panel or portion 36 between the two-breast receiving cups 34. The two breast-receiving cups 34 are coupled to one another in the front by coupler 58. The coupler 58 can comprise any device to couple two adjacent center portions 36, and thus, coupling two adjacent breast-receiving cups 34. The coupler 58 can comprise a clasp, a closed loop such as the engaging component 30, or an open or partially open hook. As depicted, the coupler 58 has an S-shaped hook whereby the right portion is closed and the left portion is open. The open portion of the hook allows the hook to be removed from the center portion 36. This enables the bra to be opened from the front. The hook cannot be removed from the closed section because there is no opening on the closed section.

When on body, breast receiving cups 34 experience forces in many directions depending upon movement, fit of the bra, size of the user, etc. In some embodiments the receiving cups 34 are pulled away from one another. Thus, the coupler 58 counteracts theses forces to ensure the receiving cups 34 remain coupled.

In one embodiment, as shown in FIG. 6, for example, there is a single coupler 58. However, in other embodiments, as depicted in FIGS. 13 and 14, there are two or more couplers 58. In FIGS. 13 and 14, for example, there is a primary coupler 58 and a secondary coupler 59. As depicted the primary coupler 58 is longer than the secondary coupler 59 and is located at the base of the center portion 36. As shown, there is a separation gap between the two couplers. In one embodiment the primary coupler 58 couples the breast receiving cups 34 together whereas the secondary coupler 59 offers an additional lever of customization. For additional support, for example, the secondary coupler 59 can be latched. When the secondary coupler 59 is latched, the top of the breast receiving cups 34 are coupled to one another. The distance between adjacent cups 34 at the top is then set and controlled by the secondary coupler 59. Conversely, when the secondary coupler 59 is unlatched, the tops of the cups 34 are allowed to separate more than compared to the latched position. This affords the user an additional opportunity to further adjust the fit of the bra.

The couplers 58, 59 can be attached to the center portion 36 via any method known in the art. In one embodiment they are affixed via sewing or adhesives. In another embodiment they are attached via bonding. Bonding is a method whereby a material is compressed via heat, pressure, or a combination thereof. As an example, in one embodiment the center portion 36 has an internal layer of foam which is sandwiched between the outer layers of the center portion 36. When heat and pressure are applied, the layer of foam collapses on itself and creates a bonded region. As depicted, this creates an indented and compressed region. In FIGS. 13 and 14, bonding creates the center portion pocket 57. The bonded layer creates the pocket 57 which can then securely receive the coupler 58. As depicted, each side of the center portion 36 has a pocket 57 and its associated bonded line 61.

It is worth noting, that in one embodiment the pocket 57 and the bonding line 61 extend from the bottom of the center portion 36 up to the intersection with the underwire 60. As shown, the pocket 57 and bonding line 61 extend above and beyond the primary coupler 58, as best seen in FIG. 14. The pocket 57 and bonding line 61 extend toward and adjacent to the secondary coupler 59. This is true, as depicted, even when the secondary coupler 59 uses a separate and distinct attaching device to attach the secondary coupler to the cups 34. Having the pocket 57 and bonding line 61 extend all the way to the intersection of the underwire 60 offers increased stability and support. This prevents twisting and helps the adjacent cups 34 act more as one. In one embodiment the pocket 57, bonding line 61, and the secondary coupler 59 each reduce so-called hook swing. Hook swing is where, due to a pulling force, a vertical hook, such as the hook pictured in FIG. 13, moves to a horizontal hook. The cups 34 are pulled outward away from one another and the hook rotates to a horizontal position, increasing the distance between cups 34 in response to the outward force. The features discussed herein minimize or eliminate hook swing. First, the coupler 58 is imbedded in a pocket 57 which prevents this movement. Second, because the coupler 58 is elongated vertically, in some embodiments, the hook swing tendency is minimized. Third, due to the pocket 58 and bonding line 61 extending to the underwire 60, the bra is more rigid and structurally sound to accept and tolerate these outward forces.

It should be noted that the bonding discussed above can be used to create the gap 24 previously discussed. For example, the fastener 22 can comprise a continuous fastening portion 22 and the gap 24 is created by creating a bonding line at the location of the desired gap 24. Accordingly, the gap 24 can be created by using separate and distinct segments which are physically separated, or by using a single continuous piece which is segmented due to bonding. Thus, in one embodiment the ribbed portions discussed herein can be obtained by utilizing bonding.

Figure 9:
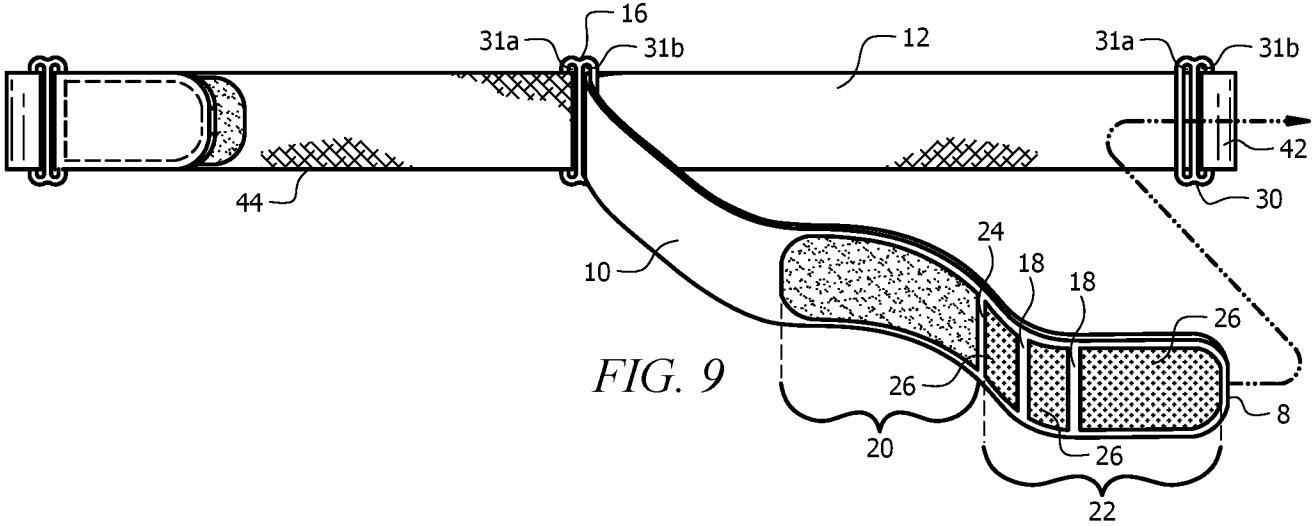
FIG. 9 depicts a close-up view of the embodiment in FIG. 8 detailing the strap in a partially open configuration prior to looping the strap through a guiding member for securing the strap.
Figure 10:
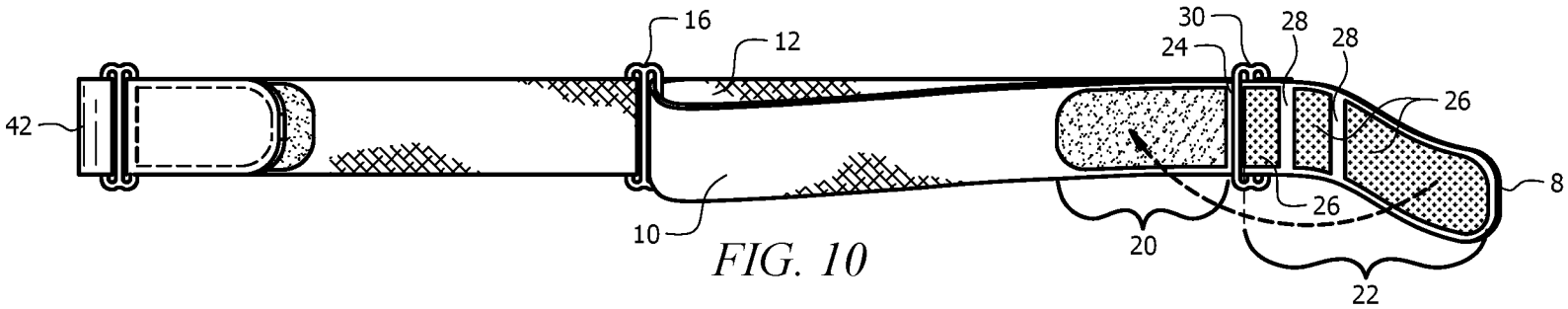
FIG. 10 depicts a close-view of the embodiment of FIGS. 8 and 9 in a partially open configuration prior to adjusting the length of the strap and securing it in a closed position.

FIGS. 8-10 depict the operation of securing an embodiment of the adjustable strap described herein in a closed position. While these figures depict an embodiment comprising two elongated straps, embodiments comprising a single strap are also possible. That is, the elongated strap 44 may be replaced with any number of strap configurations known in the art, depending on the item with which the strap is used. Additionally, the elongated strap 44 may be replaced with any number of fixed materials of a bra or item. With reference to FIG. 8, the second, or free, end 8 of the strap comprises a width sized to fit through an opening 17*b* in an engaging component 16 such that each elongated strip slidably engages the engaging component 16 and is pulled forwardly through the opening and folded forwardly back onto itself to form a first fold in the strap at the engaging component 16. The opposite end of the strap may be secured to an attachment point either at a tab 42 or a point near the tab 42. The adjacent adjustable strap 44 is shown in the closed position also comprising a width sized to fit through an opening 17*a* in the engaging component 16, forming its own first fold at the engaging component 16. The first fold causes the free end 8 of the elongated strap to be pulled away from the engaging component 16 and back towards the secured end of the strap 42. In FIG. 9, after folding forwardly and forming the first fold at the engaging component 16, the free end 8 then passes through an opening in the guiding member 30 near a desired item for use with the strap described herein. The guiding member 30 comprises a piece of hardware that may be attached near or on a portion of an item or a breast-receiving portion 34 by any means known in the art. In some embodiments, the guiding member 30 is integrated a bra or item. In some embodiments, the guiding member 30 comprises as an attachment point or tab 42, which may be attached to a portion of a garment, accessory, or other device or structure that would benefit from the flexible adjustability of the strap described herein. In FIG. 10, after passing through the guiding member 30, the strap slidably engages the guiding member 30 and its length between the engaging component 16 and the guiding member 30 may be adjusted and the end closed by mating the first and second adjacent fastening portions. The guiding member 30 comprises an opening 31*b* through which a free end 8 passes, allowing the length of the strap to slidably engage the guiding member 30 such that the fastening portions 20, 22 are mated, forming a second fold in the length of the strap. Thus, it can be seen that the engaging component 16 and the guiding member 30 serve as stabilizing components between which the length of the strap can be easily adjusted.

The engaging component 16 may comprise any number of shapes, whether planar or flat on both sides, or comprising some amount of curvature. The engaging component 16 may comprise a piece of hardware 30 having an opening, in certain embodiments. While shown in FIGS. 8-12 as an independent piece of hardware with two openings, in alternate embodiments, the engaging component comprises a single opening, such as a ring shown in FIG. 5, for receiving each elongated strap. In some embodiments, the engaging component 16 comprises two openings 17*a*, 17*b*. In some embodiments, the engaging component 16 comprise more than two openings. The desired shape may depend upon the strap configuration needed to secure the strap in place. In some embodiments, for example, the engaging component may comprise a third ring with an opening above the two openings 17*a*, 17*b* the third ring of a configuration able to engage or connect with a shoulder strap configuration comprising a T-back shape. Embodiments suitable as an engaging component should support a width of the strap while allowing for the length of the strap to slide easily along a portion of an engaging component. In some embodiments, the engaging component comprises a curvilinear shape. In some embodiments, an engaging component comprises a convex or concave shape. In certain embodiments for securing the adjustable strap to a non-bra item, the engaging component may comprise a rod, bar, or other rigid or even semi-rigid structure. Additional configurations of the engaging component 16 are therefore also within the scope of the invention.

In the Figures directed towards various bra embodiments, each of the two openings 17*a*, 17*b* is sized to fit the width w of a respective elongated strap 40*a*, 40*b*. In some embodiments, the engaging component 16 comprises an opening sized and shaped to allow for the length of the elongated strap to easily slide against an inner perimeter of an outer edge of the engaging component 16. Thus, as shown in the drawings, the opening 17*a* comprises a substantially straight inner perimeter, allowing the strap to fold back on itself and form a first crease parallel to the inner perimeter of the opening 17*a*. In some embodiments, the engaging component 16 comprises a substantially straight inner perimeter edge to support the elongated strap in operation. In some embodiments, the engaging component 16 comprises an opening only slightly taller than the width of the strap, the engaging component 16 thus designed to fit the strap such that the strap will slide in a longitudinal direction. Other embodiments where the height of an inner perimeter of the engaging component 16 is greater than the width of the strap may allow for some vertical movement if desired.

Referring back to FIG. 5, the backstrap comprised of two identical adjustable straps forms a symmetrical backstrap. Other embodiments wherein either of the adjustable straps 40*a*, 40*b* is replaced with a different strap are also possible, including without limitation a fixed strap or other adjustable strap such as a buckle strap. Moreover, some embodiments may also comprise a single adjustable back strap with the engaging component 16 on one side of the breast-receiving portion and a guiding member 30 on the opposing side of the breast-receiving portion. A guiding member 30 may also be positioned below the breast-receiving portion in some embodiments.

As best shown in FIGS. 7-10, in some embodiments, a tab 42 is attached to an outer surface or trim of the item or breast-receiving portion 34, the tab 42 comprising a material permanently looped through an opening 31*b* of the guiding member 30. The guiding member 30 may also be attached directly to or within the wing portion 38 of an item by any means known in the art so long as each free end 8 is able to pass through the guiding member and fold forwardly back onto itself to form the fold capable of mating at least portions of the fastening portions 20, 22 together.

In some embodiments, the side fastening feature, depicted in a worn, closed configuration in FIG. 7, provides convenient and simple reach for a user to fasten the bra around the user's torso and ensure proper fit of the cups to their breasts. A user may simply reach to the side of the body, in some embodiments, to adjust and fasten one or both straps 40*a*, 40*b* in place. This allows for a customizable, comfortable fit around a user's torso. In other embodiments, the elongated strap may be pulled towards the front underneath the breast-receiving portion and the user need only reach to the front to fasten the strap(s) in place.

Figure 11A:
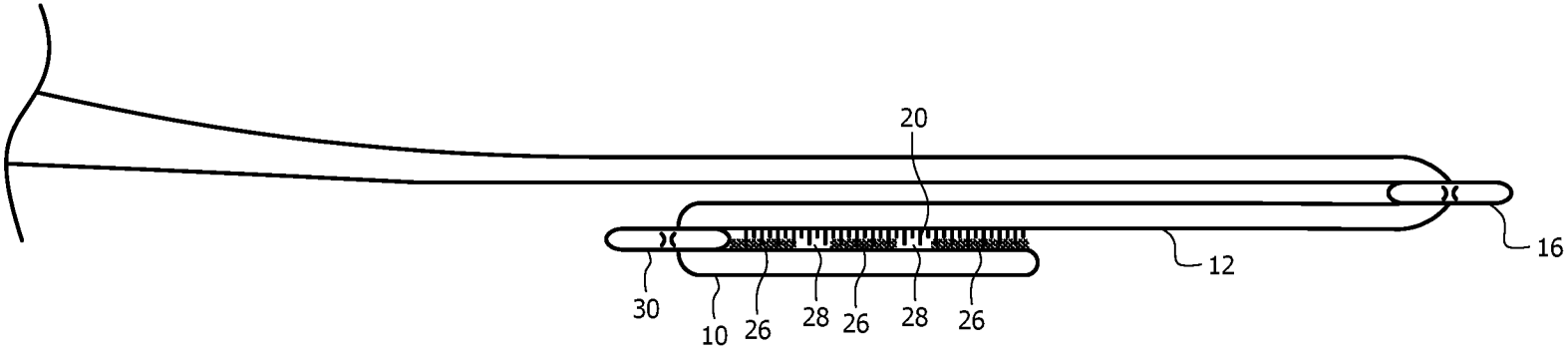
FIG. 11*a* depicts a close-up view of an embodiment of an adjustable strap described herein in a closed position.
Figure 11B:
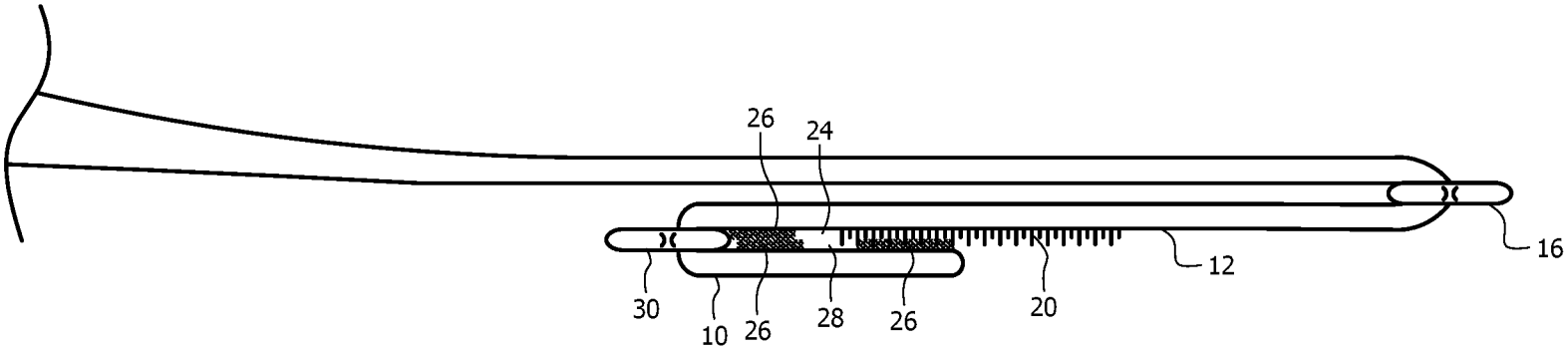
FIG. 11*b* depicts a close-up view of an embodiment of an adjustable strap described herein in an alternate closed position.

FIGS. 11*a* and 11*b* depict a detailed view of the mating configuration in some embodiments. While these figures depict embodiments comprising two folds, a similar mating configuration can be achieved with embodiments comprising any number of folds. FIG. 11*a* shows that the adjustable strap creases at a gap 24 between the first fastening portion 20 and the mating second fastening portion 22. Gap 24 thus comprises a sufficient width to wrap around the engaging component (or the guiding component, depending upon the embodiment desired) and provides for a substantially flat fold. By contrast, without the gaps or spaces, the fold would be bulky from the interaction with the fastening portions. In FIG. 11*b*, another embodiment demonstrates that the adjustability provided by the strap's mating portions, wherein the second fold creases at a space 28 between spaced apart fastening portion 26. Having creased the strap at a gap 24 or space 28, the adjustable strap twice folded along its length forms a substantially flat configuration at each fold. Such configuration is often highly desirable when wearing a bra to avoid obvious and frumpy bumps visible in certain types of clothing. In some embodiments, the presence of the gap 24 or space 28 further conveniently provides a user with an audible or tactile effect stemming from the interaction of the guiding member with the space or gap as the strap slides through the guiding member prior to mating the fastening portions. A clicking sound and/or tactile effect can help a user quickly recognize the proper mating point of the fastening portions of the strap for appropriate support around their torso.

The bra embodiments shown and described above provide several benefits to a user. First, the end piece 8, which is pulled or loosened through the guiding member to tighten or loosen and secure the bra on a user is easy to reach, whether it be adjusted and secured on one or both sides of the bra, or on the front. This convenient reach is useful to those individuals who may feel discomfort when reaching around the back of the torso. Second, the engaging component 16 provides a break across the length of the backstrap. This allows for air to better circulate at the engaging component 16, where there is a break in between the first fold of each adjacent adjustable strap 40*a*, 40*b*. Curved, concave, or convex embodiments may also provide comfort on the backbone. Third, symmetrical or substantially symmetrical embodiments with the engaging component 16 at the spine of a user may provide benefits to those suffering from conditions such as scoliosis. Fourth, the varying adjustable points provided by the female and mating male fastening portions removes the guesswork and inaccurate sizing problems, ensuring a customizable fit around the torso for proper support and lift of the breasts and/or subjective comfort of the user. The adjustable strap thus provides to the wearer more sizing options, while improving the look and feel of the undergarment, despite any common fluctuations in girth around a user's torso. For example, an underbust measurement of a user can increase or decrease when sitting or standing. Bra embodiments described herein accommodate these increases to the diaphragm area. Moreover, whether a user experiences common weight losses or gains, pregnancy, or medical conditions that call for flexibility on either side (such as with a colostomy bag), having an adjustable length on either side will allow a user more options for comfortable fit or use. Fifth, the width and the flexibility of the strap helps avoid or eliminate undesirable flesh bulges often experienced around the backstrap of a bra due to an improper fit.

Having described a bra embodiment comprising an improved adjustable strap, those armed with this disclosure will recognize that the adjustable strap may be beneficially applicable to any number of items, including, for example, garments, bras, corsets, belts, baseball caps, hats, backpacks and bra shoulder straps. Moreover, the adjustability of the strap may be beneficial in the medical field for any number of braces encircling a torso or limb or even, for example, when holding an IV in place or when a colostomy bag is needed. Luggage or package carriers may also benefit from the strap described herein.

By way of example, embodiments of an adjustable strap connected to an item other than a bra may comprise a length extending between a first end 6 to a second end 8, the first end 6, either releasably or permanently, to an attachment point. For example, the first end may be releasably or permanently secured to an attachment point on an apparel or accessory item. An embodiment of an adjustable strap for use in other fields is further slidably engageable with an engaging component positioned a distance from the attachment point. In some embodiments, the attachment point comprises an engaging component. In other embodiments, the item comprises a separate engaging component such that when folded and secured, the adjustable strap will provide tension between the attachment point and the engaging component. As described in above embodiments, the length is folded forwardly over on itself at or through the engaging component such that the second end is pulled towards the first end, forming a first fold in the length of the strap. A guiding component near the attachment point adjustably engages the first fastening portion with the mating second fastening portion as the length is folded forwardly on itself near the second (free) end to form a second fold at the guiding component, the second fold selectively mating the fastening portion.

Figure 12:
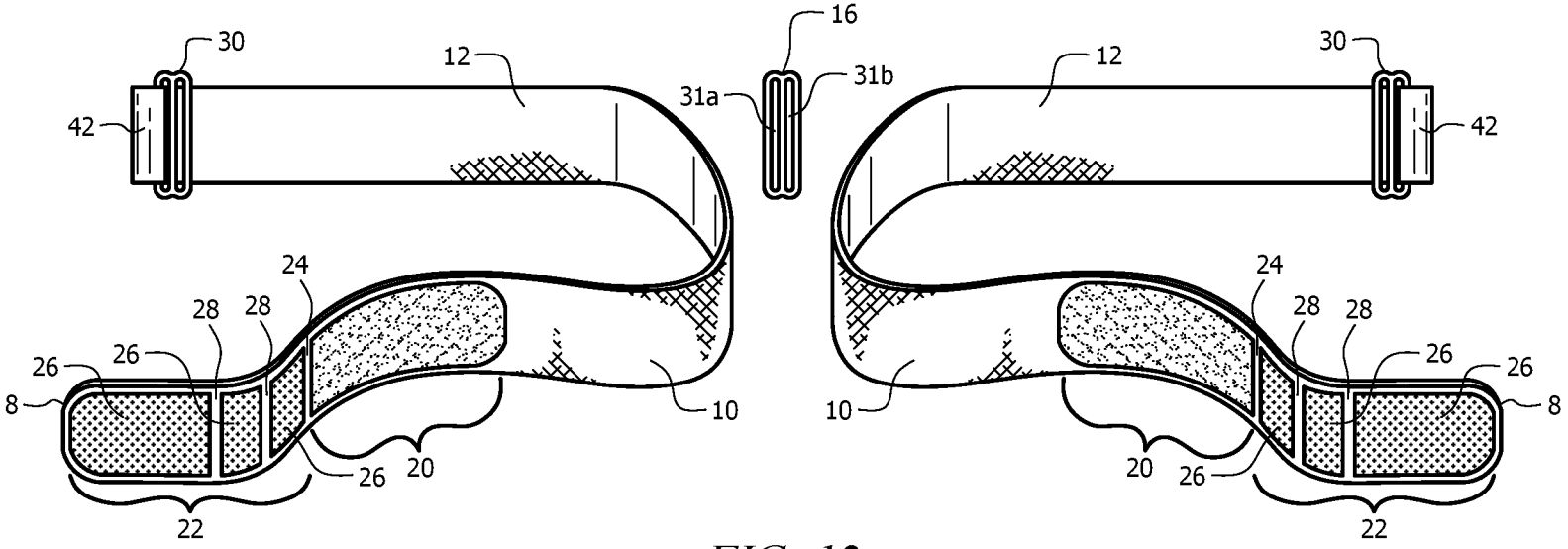
FIG. 12 depicts an embodiment of an adjustable strap system described herein.

In some embodiments, the guiding component may be releasably or permanently secured to an apparel or accessory item. In some embodiments, the attachment point the engagement point, and the guiding component will be substantially aligned with one another and as tension is formed across the points, a weight is supported or held in place. FIG. 12 depicts an embodiment of an adjustable strap system comprising at least two elongated straps. The tabs 42, at the first ends of the straps, may be secured to a portion of an item, whether the same item (as described in various bra embodiments above) or two different items desired to be attached to one another. The tabs may be permanently or temporarily secured to a portion of any number of items that may benefit from the adjustable strap system described herein. Additionally, each tab 42 may be attached to different objects, if it is desired to secure to one another, for example. In any embodiment, the second (free) ends 8 comprise the first and second fastening portions, as described above, and engage with an engaging component 16, which may comprise one or more openings and any number of shapes to provide for the free ends to pass and easily slide through during adjustment of the lengths of the straps. Similarly, the strap should easily slide through the guiding component 30 before secured the straps in the closed position.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition is expressly set forth in the specification in a definitional manner that directly and unequivocally provides the special definition for the term or phrase.

The terms "including," "comprising," "having," and variations thereof mean "including but not limited to," unless expressly specified otherwise. When used in the appended claims, in original and amended form, the term "comprising" is intended to be inclusive or open-ended and does not exclude any additional, unrecited element, method, step or material. The term "consisting of" excludes any element, step or material other than those specified in the claim. Unless specifically set forth herein, the terms "a", "an", and "the" are not limited to one of such elements, but instead mean "at least one," unless otherwise specified.

The invention illustratively disclosed herein suitably may be practiced in the absence of any element which is not specifically disclosed herein. The strap disclosed herein may be suitably adjusted or worn in the absence of any element or limitation that is not specifically disclosed herein. Thus, articles or items described herein may be free of any limitation or characteristic not specifically described herein.

While the invention has been particularly shown and described with reference to certain embodiments, it will be understood by those skilled in the art that various changes in form and detail may be made therein without departing from the spirit and scope of the invention.

Additional Description

The following clauses are offered as further description of the disclosed invention.

Clause 1. An adjustable strap comprising:

a length extending between a first end to a second end, the length comprising a first side and a second side;

a first fastening portion adjacent to a mating second fastening portion, the first fastening portion and the mating second fastening portion near one end of the length and on one side of the length;

wherein at least one of the first fastening portion and the mating second fastening portion comprises a plurality of fastening members with at least one space between each of the plurality of fastening members.

Clause 2. The adjustable strap of any proceeding or preceding clause wherein the first fastening portion and the mating second fastening portion are near the second end and the first end is secured to an attachment point.

Clause 3. The adjustable strap of clause 1 or clause 2 wherein the second end communicates with the attachment point to form a loop around an object, the second end folded at the attachment point, thereby mating the first fastening portion and the mating second fastening portion and forming a single fold in the length of the strap.

Clause 4. The adjustable strap of any proceeding or preceding clause wherein the first fastening portion and the mating second fastening portion comprises a hook fastening material and a mating loop fastening material.

Clause 5. The adjustable strap of any proceeding or preceding clause wherein the first fastening portion and the mating second fastening portion comprise a magnet.

Clause 6. The adjustable strap any proceeding or preceding clause wherein the plurality of fastening members comprises segments of the fastening material.

Clause 7. The adjustable strap of any proceeding or preceding clause wherein the plurality of fastening members comprises ribbed portions of the fastening material.

Clause 8. The adjustable strap of any proceeding or preceding clause wherein the first fastening portion mates with the second fastening portion at a first fold.

Clause 9. The adjustable strap of any of clauses 1-2 or clauses 4-7 wherein the length folds on itself at an engaging component positioned a distance from the attachment point, such that the second end is pulled towards the first end, thereby forming a first fold at the engaging component.

Clause 10. The adjustable strap of clause 9 wherein the length forms a second fold at a guiding component near the attachment point.

Clause 11. The adjustable strap of clause 9 or clause 10 wherein the first fastening portion mates with the second fastening portion at the second fold.

Clause 12. The adjustable strap of clause 10 or clause 11 wherein the second fold creases at a gap between the first fastening portion and the mating second fastening portion.

Clause 13. The adjustable strap of clause 10 or clause 11 wherein the second fold creases at the space between the plurality of fastening members.

Clause 14. An article worn by a user, said article comprising:

an adjustable strap comprising a length extending from a first end to a second end, the first end secured to an attachment point and the second end comprising a first fastening portion adjacent to a mating second fastening portion, the adjacent fastening portions near the second end and on one side of the adjustable strap;

wherein at least one of the first fastening portion and the mating second fastening portion comprises a plurality of fastening members with at least one space between each of the plurality of fastening members.

Clause 15. The article of clause 14 or any proceeding clause wherein the adjacent fastening portions comprise a gap between the first fastening portion and the mating second fastening portion on the length of the strap, and wherein the first fastening portion mates with at least a portion of the second fastening portion to form a fold in a closed position.

Clause 16. The article of clause 15 wherein the fold creases at the gap.

Clause 17. The article of clause 15 wherein the fold creases at one of the spaces between the plurality of fastening members.

Clause 18. The article of any proceeding or preceding clause wherein an adjustment of the length of the strap provides a tactile effect.

Clause 19. The article of any proceeding or preceding clause wherein the first fastening portion and the mating second fastening portion comprises a hook fastening material and a mating loop fastening material.

Clause 20. The article of any proceeding or preceding clause wherein the first fastening portion and the mating second fastening portion comprise a magnet.

Clause 21. The article of any preceding clause wherein the second end communicates with the attachment point to form a loop around an object, the second end folded about the attachment point, thereby mating the first fastening portion and the mating second fastening portion.

Clause 22. The article of any proceeding or preceding clause wherein the plurality of fastening members comprises segments of the fastening material.

Clause 23. The article of any proceeding or preceding clause wherein the plurality of fastening members comprises ribbed portions of the fastening material.

Clause 24. The article of any of clauses 14-20 or clauses 22-23 wherein the length of the strap folds on itself at an engaging component positioned a distance from the attachment point, such that the second end is pulled towards the first end, thereby forming a first fold at the engaging component.

Clause 25. The article of clause 24 wherein the first fastening portion mates with the second fastening portion at the first fold.

Clause 26. The article of clause 24 wherein the length of the strap forms a second fold at a guiding component near the attachment point.

Clause 27. The article of clause 26 wherein the first fastening portion mates with the second fastening portion at the second fold.

Clause 28. A bra comprising:

a breast-receiving portion and at least two elongated straps, each elongated strap comprising a length extending from a first end to a second end and comprising a first side and a second side, the first end secured to an attachment point on an item, wherein each elongated strap comprises a first fastening portion adjacent to a mating second fastening portion on one side, wherein the fastening members are near the second ends of each of the elongated straps.

Clause 29. The bra of any proceeding or preceding clause wherein at least one of the first fastening portion and the mating second fastening portion comprises a plurality of fastening members with at least one space between each of the plurality of fastening members.

Clause 30. The bra of any proceeding or preceding clause wherein the first fastening portion and the mating second fastening portion comprises a hook fastening material and a mating loop fastening material.

Clause 31. The bra of any proceeding or preceding clause wherein the first fastening portion and the mating second fastening portion comprise a magnet.

Clause 32. The bra of any proceeding or preceding clause wherein the plurality of fastening members comprises segments of the fastening material.

Clause 33. The bra of any proceeding or preceding clause wherein the plurality of fastening members comprises ribbed portions of the fastening material.

Clause 34. The bra of any proceeding or preceding clause wherein the second ends of each elongated strap fit through an opening in an engaging component such that each elongated strip is pulled forwardly through the opening and back onto itself to form a first fold on each elongated strap at the engaging component, each first fold causing the second ends of each elongated strap to be pulled away from the engaging component and back towards the breast-receiving portion.

Clause 35. The bra of clause 34 wherein the first fastening portion slidably engages with the engaging component and produces a tactile effect to mate with the second fastening portion at the first fold.

Clause 36. The bra of clause 34 wherein the first fold creases at a gap between the first fastening portion and the mating second fastening portion.

Clause 37. The bra of clause 34 wherein the first fold creases at the space between the plurality of fastening members.

Clause 38. The bra of clause 34 comprising a guiding component near the attachment point and wherein the length forms a second fold at the guiding component.

Clause 39. The bra of clause 38 wherein the first fastening portion mates with the second fastening portion at the second fold.

Clause 40. The bra of clause 39 wherein the second fold creases at a gap between the first fastening portion and the mating second fastening portion.

Clause 41. The bra of clause 39 wherein the second fold creases at a space between the plurality of fastening members.

Clause 42. A bra comprising:

a breast-receiving portion and an elongated strap attached to the breast-receiving portion, wherein the elongated strap comprises a first side, a second side opposite the first side, and a length extending from a first end to a second end, the first end secured to the bra and the second end comprising a first fastening portion adjacent to a mating second fastening portion on one side of the length, wherein at least one of the first fastening portion and the mating second fastening portion comprises a plurality of fastening members with at least one space between each of the plurality of fastening members.

Clause 43. The bra of any proceeding or preceding clause wherein the first end is secured to an attachment point on the bra.

Clause 44. The bra of any proceeding or preceding clause wherein the first fastening portion and the mating second fastening portion comprise a hook fastening material and a mating loop fastening material.

Clause 45. The bra of any proceeding or preceding clause wherein the first fastening portion and the mating second fastening portion comprise a magnet.

Clause 46. The bra of any proceeding or preceding clause wherein the plurality of fastening members comprises segments of the fastening material.

Clause 47. The bra of any proceeding or preceding clause wherein the plurality of fastening members comprises ribbed portions of the fastening material.

Clause 48. The bra of any proceeding or preceding clause wherein the length of the elongated strap comprises a first fold at an engaging component a distance from the first end, the length folding over on itself at the engaging component such that the second end is pulled towards the first end to form the first fold.

Clause 49. The bra of clause 48 wherein the first fastening portion mates with the second fastening portion at the first fold.

Clause 50. The bra of clause 49 wherein the first fold creases at a gap between the first fastening portion and the mating second fastening portion.

Clause 51. The bra of clause 49 wherein the first fold creases at the space between the plurality of fastening members.

Clause 52. The bra of clause 48 comprising a guiding component near the breast-receiving portion, the second end engaging the guiding component to pull the second end towards the engaging component and form a second fold at the guiding component.

Clause 53. The bra of clause 52 wherein the first fastening portion mates with the second fastening portion at the second fold.

Clause 54. The bra of clause 53 wherein the second fold creases at a gap between the first fastening portion and the mating second fastening portion.

Clause 55. The bra of clause 53 wherein the second fold creases at the space between the plurality of fastening members.

Clause 56. The bra of any proceeding or preceding clause comprising a second strap attached to an opposite end of the breast-receiving portion, the second strap and the elongated strap forming a backstrap of the bra, the bra thereby encircling the torso of a user when in a closed position.

Clause 57. The bra of clause 56 wherein the second strap and the elongated strap form a symmetrical backstrap with the engageable component at the center of the symmetrical backstrap.

Clause 58. The bra of clause 42 comprising two adjacent breast-receiving cups, wherein each breast-receiving cup comprises a center portion, and wherein said adjacent breast-receiving cups are coupled at said center portion.

Clause 59. The bra of claim 58 wherein said breast-receiving cups are coupled via a coupler.

Clause 60. The bra of claim 58 wherein said breast-receiving cups are coupled via a primary coupler and a secondary coupler.

Clause 61. The bra of clause 42 wherein each center portion comprises a pocket into which a coupler fits.

Clause 62. The bra of clause 61 wherein said center portion further comprises a bonding line.

Clause 62. The bra of clause 61 wherein said pocket extends the entire height of said center portion.

Clause 63. The bra of clause 62 wherein said pocket extends to intersect an underwire.

Clause 64. The bra of clause 62 wherein said pocket is formed via bonding.

What is claimed is:

1. An article worn by a user, said article comprising:

an adjustable strap comprising a length extending from a first end to a second end, the first end secured to an attachment point and the second end comprising a first fastening portion adjacent to a mating second fastening portion, the adjacent fastening portions near the second end and on one side of the adjustable strap;

wherein at least one of the first fastening portion and the mating second fastening portion comprises a plurality of fastening members with at least one space between each of the plurality of fastening members;

wherein the length of the strap folds on itself at an engaging component positioned a distance from the attachment point, such that the second end is pulled towards the first end, thereby forming a first fold at the engaging component;

wherein the first fastening portion mates with the second fastening portion at the first fold; and wherein the length of the strap forms a second fold at a guiding component near the attachment point.

2. The article of claim 1 wherein the adjacent fastening portions comprise a gap between the first fastening portion and the mating second fastening portion on the length of the strap, and wherein the first fastening portion mates with at least a portion of the second fastening portion to form a fold in a closed position.

3. The article of claim 2 wherein the fold creases at the gap.

4. The article of claim 2 wherein the fold creases at one of the spaces between the plurality of fastening members.

5. The article of claim 1 an adjustment of the length of the strap provides a tactile effect.

6. The article of claim 1 wherein the first fastening portion and the mating second fastening portion comprises a hook fastening material and a mating loop fastening material.

7. The article of claim 1 wherein the first fastening portion and the mating second fastening portion comprise a magnet.

8. The article of claim 1 wherein the second end communicates with the attachment point to form a loop around an object, the second end folded about the attachment point, thereby mating the first fastening portion and the mating second fastening portion.

9. The article of claim 1 wherein the plurality of fastening members comprises segments of the fastening material.

10. The article of claim 1 wherein the plurality of fastening members comprises ribbed portions of the fastening material.

11. The article of claim 1 wherein the first fastening portion mates with the second fastening portion at the second fold.

* * * * *